US006249078B1

(12) United States Patent
Mimasu

(10) Patent No.: US 6,249,078 B1
(45) Date of Patent: Jun. 19, 2001

(54) MICROWAVE-EXCITED DISCHARGE LAMP

(75) Inventor: Mutsumi Mimasu, Hikone (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/123,279

(22) Filed: Jul. 28, 1998

(30) Foreign Application Priority Data

Jul. 31, 1997 (JP) ..... 9-205674

(51) Int. Cl.[7] ..... H01J 1/50; H01J 23/10; H01J 29/76; H01J 3/20; H01J 3/32

(52) U.S. Cl. ..... 313/161; 313/637; 313/638; 313/639; 313/942

(58) Field of Search ..... 313/161, 637, 313/638, 639, 642, 643, 153, 160

(56) References Cited

U.S. PATENT DOCUMENTS 4,001,626 * 1/1977 Drop et al. ..... 313/229
4,206,387 * 6/1980 Kramer et al. ..... 313/641
4,705,987 * 11/1987 Johnson ..... 313/642
4,783,615 * 11/1988 Dakin ..... 313/642
4,972,120 * 11/1990 Witting ..... 313/638
4,978,891 * 12/1990 Ury ..... 315/117
5,479,072 * 12/1995 Dakin et al. ..... 313/643
5,512,800 * 4/1996 Omura et al. ..... 313/638
5,682,082 * 10/1997 Wei et al. ..... 313/638
5,861,706 * 1/1999 Lapatovich et al. ..... 313/634
5,864,210 * 1/1999 Hochi et al. ..... 313/641
5,889,368 * 3/1999 Doell et al. ..... 313/637
5,903,091 * 5/1999 MacLennan et al. ..... 313/638
5,920,152 * 7/1999 Yasuda et al. ..... 313/642
5,965,984 * 10/1999 Horiuchi et al. ..... 313/638
5,990,627 * 11/1999 Chen et al. ..... 313/234

FOREIGN PATENT DOCUMENTS 06013052 1/1994 (JP) .

OTHER PUBLICATIONS

A. Hochi et al., "Novel High Color Rendering Electrodeless HID Lamp Containing InX", *International Display Workshop* (IDW), pp. 435–438, (1996) (No Month).

* cited by examiner

*Primary Examiner*—Ashok Patel
*Assistant Examiner*—Mariceli Santiago
(74) *Attorney, Agent, or Firm*—Akin, Gump, Strauss, Hauer & Feld, L.L.P.

(57) ABSTRACT

In a microwave-excited discharge lamp of the present invention, a rare gas 2, a mercury halide 3 as a buffer material, and a metal halide 4 as a luminous material are sealed within an discharge tube 1. This achieves a microwave-excited discharge lamp having excellent stability and a variety of light colors.

6 Claims, 5 Drawing Sheets

MICROWAVE-EXCITED DISCHARGE LAMP

BACKGROUND OF THE INVENTION

The present invention relates to a microwave-excited discharge lamp which emits light by discharge under a microwave electromagnetic field.

Conventionally, in a liquid crystal projection display using a liquid crystal panel, an electrode discharge lamp including a metal halide lamp and a xenon lamp has been used as a light source. As is well known, in the light source of the liquid crystal projection display, a light output must be collimated through a lens for projection into the liquid crystal panel. Therefore, as the light source, it has been necessary to reduce the size of a light emitting part as much as possible in order to increase its light utilization. Furthermore, it has been required to retain the light output even when the size of the light emitting part is reduced. In existing electrode discharge lamps including the metal halide lamp, the size reduction of the light emitting part has been achieved by shortening a gap of electrodes thereof. However, in the case that the gap of the electrodes is shortened without reducing the light output, electric power applied to the electrodes inevitably becomes large in the electrode discharge lamp. As a result, the lifetime of the electrode discharge lamp has been extremely short (several thousand hours) compared with the lifetime required for a television monitor and the like. Various efforts have been made to date, but the electrode discharge lamp that can satisfy the brightness and lifetime requirements at the same time has not yet been developed or commercially implemented.

In recent years, an inherently long life electrodeless discharge lamp, which is free from electrode deterioration determining the above-mentioned lifetime of the electrode discharge lamp, has been attracting attention. One commercial implementation of the electrodeless discharge lamp is a microwave-excited discharge lamp which emits light by discharge under a microwave electromagnetic field formed by a microwave (in the 1 GHz to several tens of GHz band).

As a conventional microwave-excited discharge lamp, there is a description in IDW (International Display Workshop), 1996 version, pp. 435–438 ("Novel High Color Rendering Electrodeless HID Lamp Containing InX). This conventional microwave-excited discharge lamp uses a discharge tube with thickness about 1.5 mm and outer diameter 15, 20, 30, or 40 mm. Inside of the discharge tube is filled with argon (Ar) and an indium halide, namely, indium iodide (InI) or indium bromide (InBr).

When such conventional microwave-excited discharge lamp is used as the aforementioned light source instead of a short arc HID lamp, the discharge tube must be made smaller with its inner diameter reduced to about 3 mm to 8 mm. However, as is well known, in the microwave-excited discharge lamp, the smaller the discharge tube is made, the closer becomes the distance between the tube wall and the plasma discharge generated in the discharge tube, resulting in higher tube wall temperature. Accordingly, in the conventional microwave-excited discharge lamp, when the discharge tube is reduced in size, it has become necessary to cool the lamp in order to maintain stable operating condition, and it has also been necessary to control the lamp temperature with high accuracy.

It is known to seal mercury as a buffer gas within the discharge tube in order to maintain the stable operating condition. However, in the conventional microwave-excited discharge lamp, there is a problem of a low luminous efficacy when the amount of the buffer gas comprising mercury is increased. As a result, in the conventional microwave-excited discharge lamp, it is necessary that the amount of mercury to be sealed inside the discharge tube is extremely small. However, accurately sealing a very small amount of mercury into the discharge tube has been impracticable in mass production, though it may be possible in the laboratory. Therefore, it has been difficult to use the conventional microwave-excited discharge lamp as the aforementioned light source.

BRIEF SUMMARY OF THE INVENTION

The object of the present invention is to provide a microwave-excited discharge lamp that can solve the aforementioned problems in the conventional microwave-excited discharge lamp and can be configured with less cost and has a long life.

In order to achieve the above-mentioned object, a microwave-excited discharge lamp comprises:

a discharge tube, and a rare gas, a mercury halide as a buffer material, and a metal halide as a luminous material sealed within the discharge tube.

With this construction, a microwave-excited discharge lamp can be obtained which is capable of being started easily even when a discharge tube is reduced in size, and which can readily provide more stable operating condition compared with the conventional microwave-excited discharge lamp. Furthermore, the microwave-excited discharge lamp can be used as a light source for a liquid crystal projection display, and it is easily possible to realize the microwave-excited discharge lamp having a small-size discharge tube that emits a variety of light colors.

In the microwave-excited discharge lamp of another aspect of the present invention, a discharge tube, and a rare gas, tin iodide as a buffer material, and a metal halide as a luminous material sealed within the discharge tube.

With this construction, a mercuryless microwave-excited discharge lamp can be achieved.

DETAILED DESCRIPTION OF THE INVENTION

Hereafter, preferred embodiments of a microwave-excited discharge lamp of the present invention is described below with reference to the accompanying drawings.

MODE FOR CARRYING OUT THE INVENTION

Figure 1:
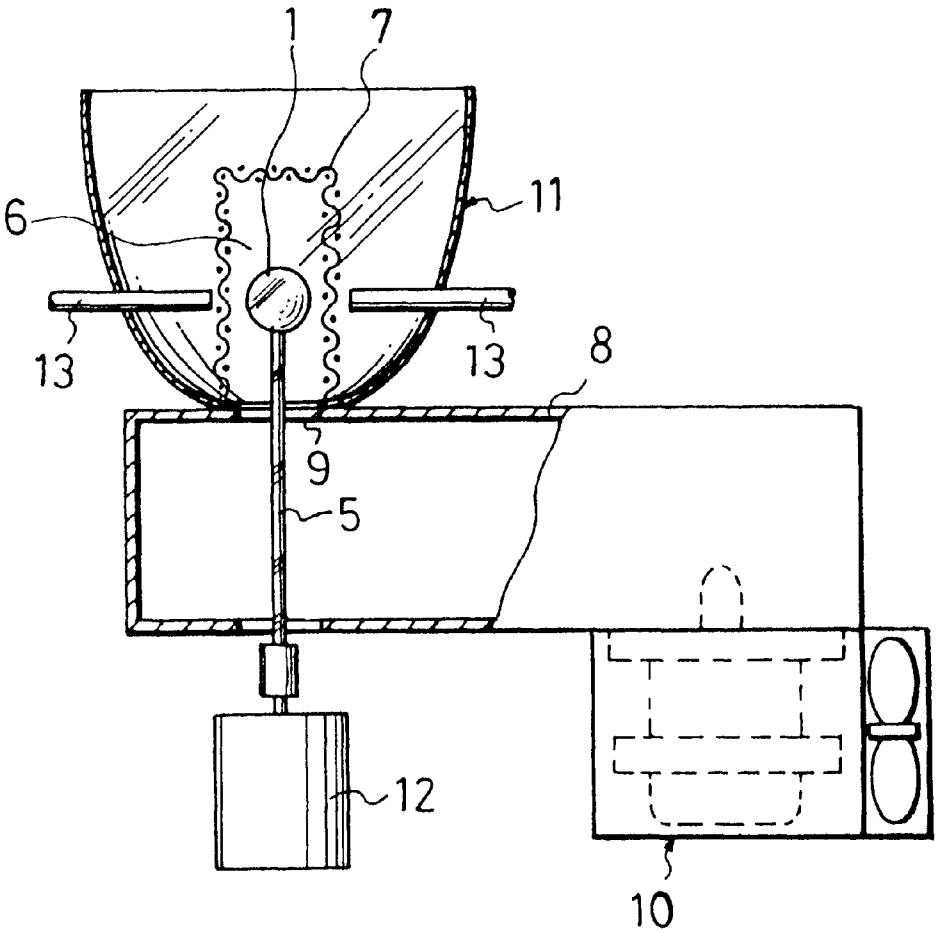
FIG. 1 is a schematic plan view showing a configuration of a microwave-excited discharge lamp apparatus equipped with a microwave-excited discharge lamp of the present invention.
Figure 2:
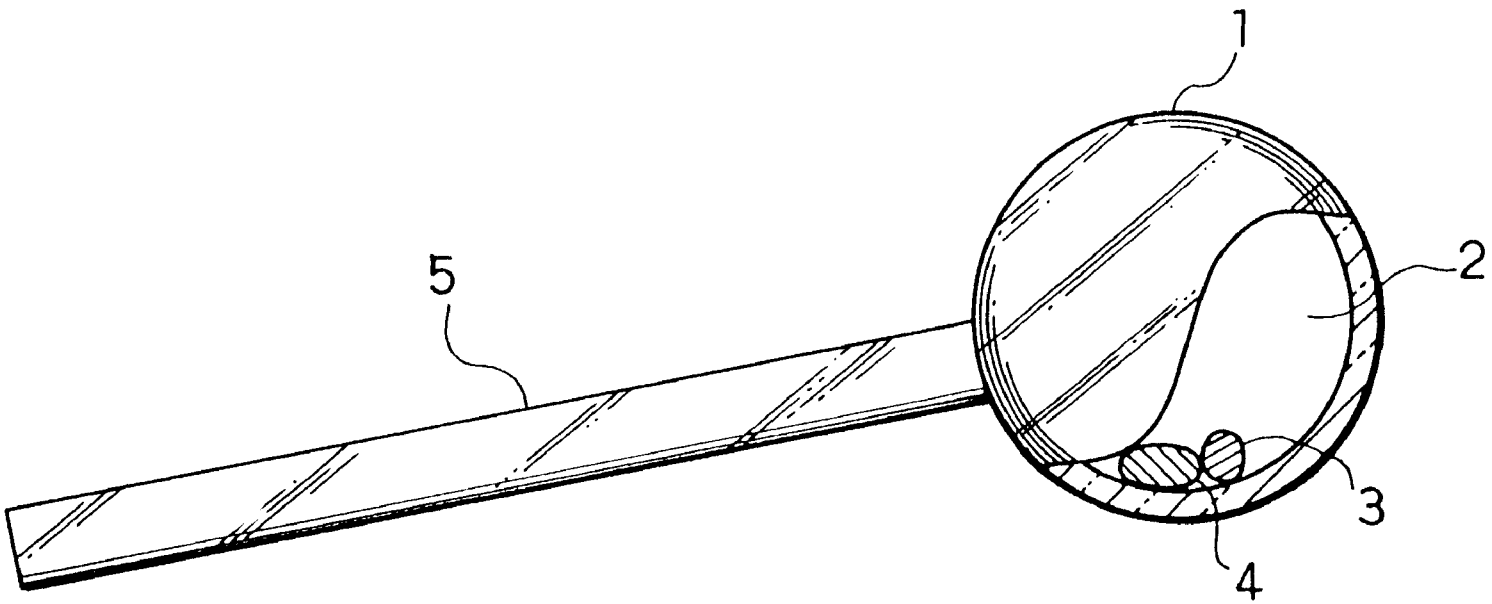
FIG. 2 is an enlarged partially sectional view showing the configuration of the microwave-excited discharge lamp embodying the present invention.

FIG. 1 is a schematic plan view showing a configuration of a microwave-excited discharge lamp apparatus equipped with a microwave-excited discharge lamp of the present invention. FIG. 2 is an enlarged partially sectional view showing the configuration of the microwave-excited discharge lamp embodying the present invention.

In FIGS. 1 and 2, a discharge tube 1 is formed from a material that is transparent to visible light, has an excellent microwave transmitting characteristic, and is capable of being used at high temperatures. More specifically, the discharge tube 1 is made of translucent quartz glass or a ceramic material such as alumina ceramic, and is shaped in a hollow spherical form, for example, with an inner diameter of 3 mm to 8 mm. This discharge tube 1 is supported on a supporting rod 5 and placed in a microwave electromagnetic field. The discharge tube 1 is not limited to a sphere, but may be formed, for example, in an elongated cylindrical shape.

The internal space of the discharge tube 1 is filled with a rare gas 2, a mercury halide 3 as a buffer material, and a metal halide 4 as a luminous material. Argon (Ar), krypton (Kr), or xenon (Xe) is used as the rare gas 2. The pressure of the rare gas 2 is regulated at ten-odd mbarr in order to easily perform a starting operation of the microwave-excited discharge lamp.

Specific examples of the mercury halide 3 include mercury iodide ($HgI_2$), mercury chloride ($HgCl_2$), and mercury bromide ($HgBr_2$). In the microwave-excited discharge lamp of the present invention, at least one of mercury iodide ($HgI_2$), mercury chloride ($HgCl_2$), and mercury bromide ($HgBr_2$) is sealed in the discharge tube 1. These mercury halides 3 are substances that do not almost contribute to a light output, but are vaporized and serve as a buffer gas during a lighting operation. Thereby, in the microwave-excited discharge lamp of the present invention, more stable operating condition can be easily obtained as compared with the conventional one (described in latter). Furthermore, in the microwave-excited discharge lamp of the present invention, the below-mentioned tin iodide ($SnI_2$) may be filled instead of the mercury halide 3 as the buffer material. This achieves a mercuryless microwave-excited discharge lamp.

Specific examples of the metal halide 4 are indium halides including indium iodide (InI, $In_{,3}$) and indium bromide (InBr), or thallium halides including thallium iodide (T1I). Particularly, the indium halides are substances having a high luminous efficacy and a good color rendering.

As shown in FIG. 1, the supporting rod 5 supports thereon the discharge tube 1 filled with the above-mentioned fillings and holds the discharge tube 1 within a cavity 6 configured with a conductor. Similar to the discharge tube 1, the supporting rod 5 is made of quartz glass or a ceramic material.

The cavity 6 is made of copper or similar metallic material, and is shaped in a cylindrical form, for example. On one open end of the cavity 6 is mounted a metal mesh member 7 to radiate a plasma discharge generating in the discharge tube 1 as the light output, and the other open end is connected to a power feeding window 9 of a waveguide 8.

This waveguide 8 is formed in accordance with the EIA (Electronic Industries Association) specification, for example, and is connected to a microwave generating apparatus 10 containing a magnetron for generating a microwave. In this arrangement, the microwave generated by the microwave generating apparatus 10 propagates through the waveguide 8 into the cavity 6, so that a required microwave electromagnetic field is formed in the cavity 6. As a result, the predetermined plasma discharge generates in the discharge tube 1, and the light output is extracted outside the cavity 6.

Further, in the microwave-excited discharge lamp of the present invention, a motor or the like driving mechanism 12 is connected to the supporting rod 5 so as to rotate the discharge tube 1. The rotation creates a centrifugal force within the discharge tube 1, so that low temperature portions of filling gases having a high density exist near a tube wall in the discharge tube 1.

On the other hand, high temperature portions of the filling gases having a low density exist near the rotational axis, namely, the center of the discharge tube 1. As a result, the filling gases are dispersed so that the temperature is evenly distributed in the discharge tube 1, thereby preventing the discharge tube 1 from being damaged by localized temperature rises. Furthermore, it is possible to obtain the stable light output during the lighting operation. Further, in order to obtain the stable light output, the discharge tube 1 is cooled directly by a cooling air from nozzles 13. Alternatively, in the microwave-excited discharge lamp of the present invention, it may be possible to eliminate at least one of the rotation due to the driving mechanism 12 and the cooling air from the nozzles 13.

Now, operation of the microwave-excited discharge lamp of the present invention will be described below. The following explanation deals with the configuration in which the discharge tube 1 is filled with the mercury halide 3 and the indium halide as the metal halide 4.

First, when the microwave electromagnetic field is created in the discharge tube 1, the rare gas 2 initiates the plasma discharge. With the plasma discharge of the rare gas 2, the energy within the discharge tube 1 increases and the tube wall temperature of the discharge tube 1 rises. As the tube wall temperature rises, the mercury halide 3 begins to vaporize, and then the indium halide begins to vaporize. In this process, a difference occurs in the vaporizing (evaporating) speed between the mercury halide 3 and the indium halide because of the difference between their vapor pressures. However, when the lamp reaches the steady state operating condition, namely, when the internal pressure and the temperature at the coolest point on the inner wall of the discharge tube 1 are stabilized at the respective predetermined values, the respective vapor pressures of the mercury halide 3 and the indium halide reach equilibrium conditions proportional to the respective fill amounts.

Furthermore, in the steady state operating condition, the mercury halide 3 serves as a buffer gas, suppressing the variation of energy within the discharge tube 1, so that the even temperature distribution can be maintained. Further, since the influence of the external temperature can be reduced by increasing the amount of the mercury halide 3, it is possible to maintain the stable operating condition.

Hereafter, specific examples of the microwave-excited discharge lamp of the present invention will be explained below. In the following explanation, comparison results with a first and a second comparative examples fabricated by the inventor are shown besides the working examples in order to explain the effect of the microwave-excited discharge lamp of the present invention.

FIRST WORKING EXAMPLE AND FIRST COMPARATIVE EXAMPLE

Figure 3:
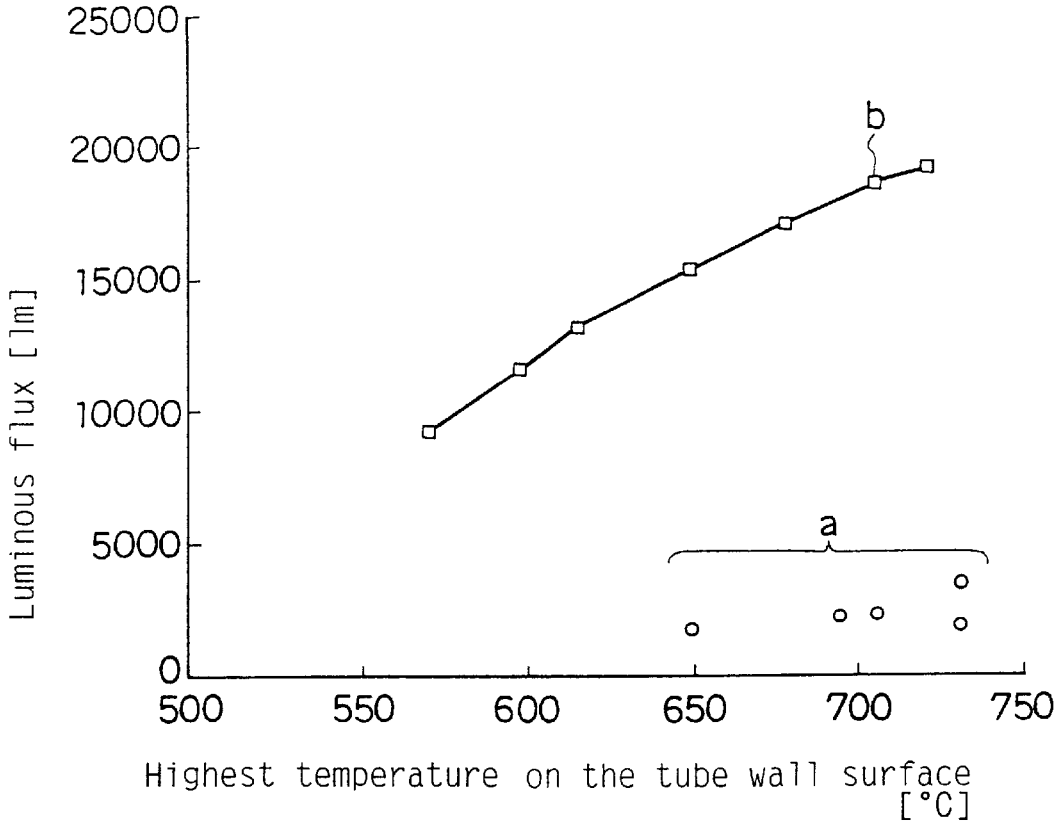
FIG. 3 is a graph showing an output characteristic of a microwave-excited discharge lamp in a first working example of the present invention and an output characteristic of a first comparative example.

FIG. 3 is a graph showing an output characteristic of a microwave-excited discharge lamp in a first working example of the present invention and an output characteristic of a first comparative example.

In the microwave-excited discharge lamps of the present working example and the first comparative example, the discharge tube 1 (FIG. 2) was constructed with the quartz glass having the inner diameter of 5 mm, and argon was filled as the rare gas 2 (FIG. 2). In the microwave-excited discharge lamp of the present working example, 1 mg of mercury iodide ($HgI_2$) was filled as the mercury halide 3 (FIG. 2), and 2 mg of indium bromide (InBr) was filled as the metal halide 4 (FIG. 2).

On the other hand, in the microwave-excited discharge lamp of the first comparative example, the mercury halide 3 was not filled, but 2 mg of indium bromide (InBr) was filled as the metal halide 4.

The inventor operated each microwave-excited discharge lamp (hereinafter referred to as the "lamp"), and examined the relationship between the luminous flux of the light output and the highest temperature on the tube wall surface of the discharge tube 1 as shown in FIG. 3. In this examination, each of the lamps was lighted while each discharge tube 1 was cooled by the cooling air from the nozzles 13 (FIG. 1) placed in close proximity to the discharge tube 1.

In the lamp of the first comparative example, the luminous flux obtained from the produced light was at small values as shown by dots "a" in FIG. 3. The reason is that, though the highest temperature on the tube wall surface was high, the coolest point temperature in the discharge tube 1 was excessively lowered by the cooling air. Thereby, most of the indium bromide in the discharge tube 1 remained in the solid state. As a result, the vapor pressure of the indium bromide in the discharge tube 1 was low, producing light at low pressure that was not enough to generate the required plasma discharge.

Figure 4:
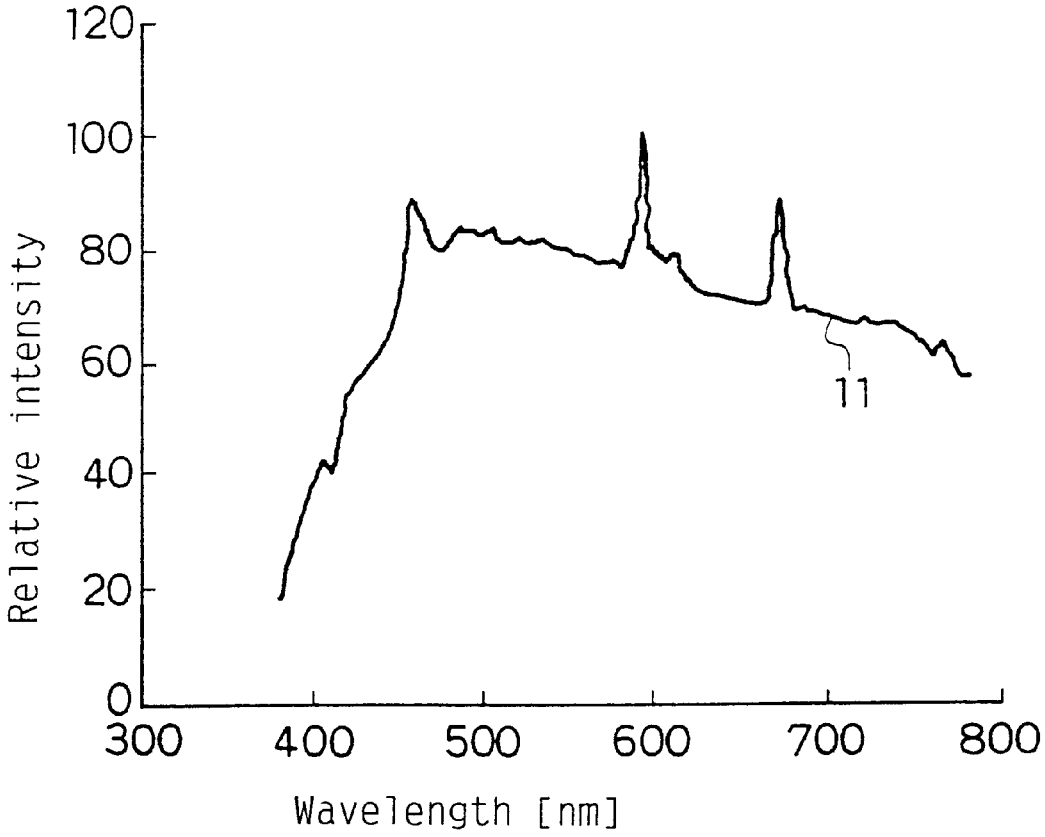
FIG. 4 is a graph showing an emission spectrum of the microwave-excited discharge lamp in the first working example of the present invention.

On the other hand, in the lamp of the present working example, the luminous flux having large values was obtained as shown by the solid line "b" in FIG. 3, and the stable light output was achieved. Furthermore, in the lamp of the present working example, a continuous emission spectrum was observed caused by specific characteristic of indium bromide having a variety of light colors as shown by a solid line 11 in FIG. 4. This is because the mercury halide 3 that does not directly contribute to illumination serves as the buffer gas, and further serving to suppress the variation of heat within the discharge tube 1 caused by the cooling with the cooling air.

It may be possible to fill metal mercury as the buffer material, but it is difficult to control the fill amount of mercury. On the contrary, in the case of the mercury halide 3, it is possible to regulate a fine fill amount of the mercury halide 3 accurately. For example, in the discharge tube 1 with an inner diameter of 8 mm, when it is desired to obtain a pressure of tens of mbarr for the lighting operation, the required fill amount in the case of the mercury halide 3 is about 0.9 to 1.1 mg (3.4 to 4.1 mg per cubic centimeter of the volume of the discharge tube 1), which means that control with an accuracy of 0.1 mg becomes necessary. Since the mercury halide 3 is solid at normal temperatures, it is easy to control the (fill) amount.

The vapor pressure of mercury is much higher than that of the mercury halide 3. Therefore, in the case of mercury, the fill amount must be made smaller than the case of the mercury halide 3, and further it is difficult to measure the fill amount of mercury. Furthermore, since mercury is liquid at normal temperatures and viscosity of mercury is extremely high, it is impossible to control accurate to 0.1 mg. Therefore, as the volume of the discharge tube 1 decreases, the difficulty in controlling the fill amount of mercury further increases.

Furthermore, the mercury halide 3 with high molecular weight moves toward and exists near the tube wall by the centrifugal force caused by the rotation of the discharge tube 1. Accordingly, even when the fill amount of the mercury halide 3 is small, the presence of the mercury halide 3 near the tube wall serves to alleviate the collisions of indium ions with the tube wall. Thereby, in the lamp of the present working example, it is possible to prevent devitrification generated by the crystallization of the quartz glass caused by the reaction between silicon including the quartz glass and indium ions, so that the lifetime of the lamp can be increased. According to the experiment conducted by the inventor, when xenon (Xe) having a higher molecular weight than argon is used as the rare gas 2, the effect of the prevention of the devitrification and the improvement of the lifetime can be further enhanced.

SECOND WORKING EXAMPLE AND SECOND COMPARATIVE EXAMPLE

Figure 5:
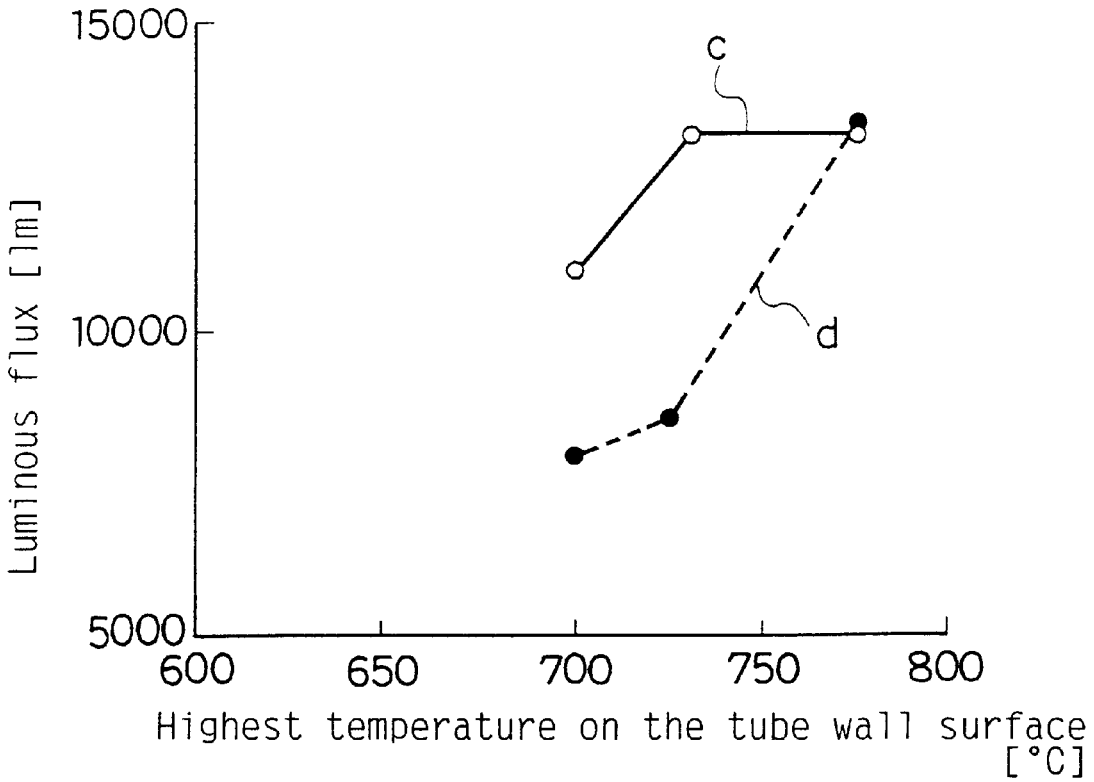
FIG. 5 is a graph showing an output characteristic of a microwave-excited discharge lamp in a second working example of the present invention and an output characteristic of a second comparative example.

FIG. 5 is a graph showing an output characteristic of a microwave-excited discharge lamp in a second working example of the present invention and an output characteristic of a second comparative example.

In the lamp of the second working example, the mercury halide 3 (FIG. 2) as the buffer material was replaced by tin iodide ($SnI_2$) having approximately the same physical quantities as the mercury halide 3. The physical quantities here refer to the molecular weight, vapor pressure, boiling point, and melting point.

In the lamps of the second working example and the second comparative example, the discharge tube 1 (FIG. 2) was constructed with the quartz glass having an inner diameter of 8 mm, and argon was filled as the rare gas 2 (FIG. 2). In the lamp of the second working example, 1 mg of tin iodide ($SnI_2$) was filled, and 5 mg of indium bromide (InBr) was filled as the metal halide 4 (FIG. 2).

Tin iodide ($SnI_2$) is the substance that does not almost contribute to the light output.

On the other hand, in the lamp of the second comparative example, 2 mg of mercury iodide ($HgI_2$) was filled as the mercury halide 3, and 5 mg of indium bromide (InBr) was filled as the metal halide 4. The lamp of the second comparative example differs from the lamp of the foregoing first working example in the inner diameter of the discharge tube 1 and the fill amounts of the mercury halide 3 and the metal halide 4.

Similar to the aforementioned first working example, the inventor operated each lamp, and examined the relationship between the luminous flux of the light output and the highest temperature on the tube wall surface of the discharge tube 1 as shown in FIG. 5. In this examination, each of the lamps was lighted while each discharge tube 1 was cooled by the cooling air from the nozzles 13 (FIG. 1) placed in close proximity to the discharge tube 1.

In the lamp of the second working example, the luminous flux as shown by a solid line "c" in FIG. 5 was obtained which was approximately the same or higher than the luminous flux obtained with the lamp of the second comparative example (the first working example) indicated by a broken line "d" in FIG. 5. Accordingly, in view of the results of the first working example, even when tin iodide is filled as the buffer material in the discharge tube 1 having an inner diameter smaller than 8 mm, it was apparent that the lamp having high luminous flux and capable of producing the stable light output can be constructed. Further, in the lamp of the second working example, since the mercury halide 3 is not used as the buffer material, unlike the first working example, a mercuryless lamp that does not use mercury can be achieved.

The lamp of the first working example has been described as using the discharge tube having the inner diameter of 5 mm, but it will be appreciated that the same effect can be obtained when the discharge tube having a smaller inner diameter is used. Since the light output decreases with decreasing size of the discharge tube, the discharge tube having the inner diameter of 3 mm or larger is preferable when the lamp is used as the light source for the liquid crystal projection display. Accordingly, the volume of the discharge tube used as the light source is preferably in the range of 14.1 to 268.1 $mm^{3,}$ Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A microwave-excited discharge lamp comprising:

a discharge tube, a rare gas, a mercury halide as a buffer material in an amount of 3.4 to 4.1 mg per cubic centimeter of volume of the discharge tube, and a metal halide as a luminous material sealed within the discharge tube.

2. A microwave-excited discharge lamp in accordance with claim 1, wherein said metal halide is an indium halide.

3. A microwave-excited discharge lamp in accordance with claim 1, wherein said rare gas is xenon.

4. A microwave-excited discharge lamp comprising:

a discharge tube, and a rare gas, tin iodide as a buffer material, and a metal halide as a luminous material sealed within said discharge tube.

5. A microwave-excited discharge lamp in accordance with claim 4, wherein said metal halide is an indium halide.

6. A microwave-excited discharge lamp in accordance with claim 4 wherein said rare gas is xenon.

* * * * *